US010953270B2

(12) United States Patent
Fazzari

(10) Patent No.: US 10,953,270 B2
(45) Date of Patent: Mar. 23, 2021

(54) EXERCISE DEVICE

(71) Applicant: Carlo Fazzari, Hamilton (CA)

(72) Inventor: Carlo Fazzari, Hamilton (CA)

( * ) Notice: Subject to any disclaimer, the term of this patent is extended or adjusted under 35 U.S.C. 154(b) by 0 days.

(21) Appl. No.: 16/122,583

(22) Filed: Sep. 5, 2018

(65) Prior Publication Data

US 2019/0070452 A1 Mar. 7, 2019

Related U.S. Application Data

(60) Provisional application No. 62/555,146, filed on Sep. 7, 2017.

(51) Int. Cl.

| | |
|---|---|
| ***A63B 21/00*** | (2006.01) |
| ***A63B 21/06*** | (2006.01) |
| ***A63B 21/072*** | (2006.01) |

(52) U.S. Cl.

CPC ..... *A63B 21/4033* (2015.10); *A63B 21/06* (2013.01); *A63B 21/072* (2013.01); *A63B 21/0726* (2013.01); *A63B 21/4035* (2015.10); *A63B 21/0004* (2013.01)

(58) Field of Classification Search

CPC ..... A63B 21/4033; A63B 21/4035; A63B 23/0211; A63B 21/0004; A63B 21/0724; A63B 21/0726; A63B 2023/0411; A63B 2023/0405; A63B 21/0722

See application file for complete search history.

(56) References Cited

U.S. PATENT DOCUMENTS

| | | | | |
|---|---|---|---|---|
| 4,690,400 | A * | 9/1987 | Metz | A63B 21/015 482/106 |
| 7,097,601 | B1 * | 8/2006 | Ronnow | A63B 21/072 482/106 |
| 8,556,781 | B1 * | 10/2013 | Fitzpatrick | A63B 21/0724 482/106 |
| D834,660 | S * | 11/2018 | Petek | D21/682 |
| 10,456,617 | B1 * | 10/2019 | Allison | A63B 22/16 |
| 2003/0181295 | A1 * | 9/2003 | Hanson, III | A63B 21/065 482/92 |
| 2007/0042879 | A1 * | 2/2007 | Panagos | A63B 21/072 482/106 |

* cited by examiner

*Primary Examiner* — Megan Anderson
*Assistant Examiner* — Andrew M Kobylarz
(74) *Attorney, Agent, or Firm* — Ridout & Maybee LLP

(57) ABSTRACT

An exercise device includes a first frame member spaced apart and parallel to a second frame member. Each frame member has equi-length right and left straight sections connected by a central arcuate section such that in the upright position the first and second frame members are each inverted V shapes. Four spaced apart transversely oriented cross members namely grips, are configured to rigidly connect together the first and second frame members. The grips each include grip apertures for attaching to the grips longitudinally oriented a right inner handle bar and a left inner handle bar to the inner right and left grips and right outer handle bar and left outer handle bar to the right and left outer grips, each handle bar is a cylindrically shaped rod and is configured for grasping with a hand and for slide-ably receiving free weight plates thereon.

15 Claims, 8 Drawing Sheets

EXERCISE DEVICE

THE FIELD OF INVENTION

The present invention relates to exercise devices and particularly relates to a multi-grip multi-function device which provides for a plurality of gripping positions and the plurality of weight attachment positions.

BACKGROUND OF THE INVENTION

There is a tremendous amount of information in the literature regarding the benefits of physical activities including the benefits of increasing physical strength through weightlifting activities. Many exercises can be performed which usually require weights or other forms of resistance. The equipment used in these exercises are normally found in public and private gyms or in some cases purchased by individuals for use in their home. In many cases, this equipment is relatively expensive and a large amount of storage space is needed for the devices.

There are many different types of exercises that can be performed using free weights. For example, linear barbells are often used for straight lifts, curls, and triceps lifts. In addition to these traditional lifts users of free weights also like to carry out close grip barbell triceps press exercises, hammer grip over head dumbbell shoulder press exercises and reverse grip bent over barbell row exercises.

There is a need for a device which enables a multitude of different free weight exercises to be carried out, some of which have been mentioned above, in addition to other exercises such as a close grip push ups and a wide grip push ups and various other exercises. Therefore there is a need for a free weight lifting device which provides for the greatest range in regards to the number of exercises that can be carried out with the device and yet have a device which is inexpensive and as compact as possible so as to take up very little space for the home user.

SUMMARY OF THE INVENTION

An exercise device includes a first frame member 106 spaced apart and parallel to a second frame member 108 oriented along a longitudinal direction 105, each first and second frame member has a right and left end 118, 120 for placing onto a support surface 191 in an upright position 111. FIG. 3 shows the exercise device resting or supported on the right and left outer grips 110 and 112 however it could also be simply resting on the right end and left end 118 and 120.

There are at least two spaced apart transversely oriented cross members also called right and left grips generally or simply "grips" which refers to all grips present in the device, configured to rigidly connect together the first and second frame members. For example in FIG. 5 shows four grips namely right and left outer grips 110, 112 and right and left inner grips 114, 116.

Each first and second frame member 106,108 includes substantially equi-length right and left straight sections 150, 152 connected by a central arcuate section 124 wherein the first and second frame members each define an angle theta 113 such that in the upright position 111 the first and second frame members are each inverted V shapes.

The right and left grips are right outer grip 110 and left outer grip 112 located at the distal right end 118 and left end 120 respectively of the first and second frame members 106, 108.

In a preferred embodiment here are at least four spaced apart transversely oriented cross members namely grips which are configured to rigidly connect together the first and second frame members, the four grips include a right outer grip and a left outer grip which are located at each of the distal right and left ends of first and second frame members, and include a right and left inner grips 114, 116 spaced from the distal right and a left ends 118, 1120 such that in the upright position 111 the right and left inner grips are elevated from the supporting surface 191.

The grips include grip apertures for attaching longitudinally handle bars thereto, the handle bars are cylindrically shaped rods and are configured for grasping with a hand or for slide-ably receiving free weight plates thereon. Herein "handle bars" refers to all handle present in the device.

The handle bars include a longitudinally oriented threaded rods extending from one end of the handle bar for thread-ably attaching into the grip aperture.

The handle bars each have an outer diameter dimensioned to slide-ably receive a free weight plate thereon.

In the upright position, the right and left inner grips are elevated from the supporting surface as shown in FIG. 8.

The grips include a right outer grip and a left outer grip which are located at each of the distal right and a left ends of first and second frame members such that in the upright position the grips contact the supporting surface as shown in FIG. 3.

The right outer grip and a left outer grip include grip apertures for attaching longitudinally oriented right and left handle bars thereto, the handle bars are cylindrically shaped rods and are configured for grasping with a hand or for slide-ably receiving free weight plates 136 and 138 thereon, such that in the upright position the outer diameter of the free weight plates make contact with the supporting surface, as shown in FIG. 7 with surface not shown.

The handle bars extending longitudinally 105 outwardly from the right outer grip and the left outer grip.

The angle theta is between 90 degrees and 170 degrees preferably the angle theta is between 100 degrees and 140 degrees, and more preferably the angle theta is between 110 degrees and 130 degrees.

In an inverted position not shown the apex 125 of the arcuate sections 124 makes contact with the supporting surface and the first and second frame members each define upright V shapes.

An exercise device includes a first frame member spaced apart and parallel to a second frame member oriented along a longitudinal direction, each frame member has a right and left end.

Each first and second frame member includes substantially equi-length right and left straight sections connected by a central arcuate section wherein the first and second frame members each define an angle theta such that in the upright position the first and second frame members are each inverted V shapes.

Preferably four spaced apart transversely oriented cross members namely grips, configured to rigidly connect together the first and second frame members; wherein the four spaced apart transversely oriented grips include a right outer grip and a left outer grip which are located at each of the distal right and left ends of first and second frame members, and include a right and left inner grip equally spaced from the distal right and a left ends respectively such that in the upright position the right and left inner grips are elevated from the supporting surface.

The grips each include grip apertures for attaching longitudinally oriented a right inner handle bar and a left inner handle bar to the inner grips and right outer handle bar and left outer handle bar to the right and left outer grips, each handle bar is a cylindrically shaped rod and are configured for grasping with a hand and for slideably receiving free weight plates thereon.

The right outer handle bar and the left outer handle bar extending longitudinally outwardly from the right outer grip and the left outer grip away from the first and second frame members.

The right outer handle bar and left outer handle bar includes a right outer free weight plate and left outer free weight plate thereon, such that in the upright position the outer diameter of the free weight plates make contact with the supporting surface.

The handle bars extending longitudinally outwardly from the right outer grip and the left outer grip as shown in FIG. 6.

BRIEF DESCRIPTION OF THE DRAWINGS

The present concept will be described by way of example only with reference to the following drawings in which.

DETAILED DESCRIPTION OF THE PREFERRED EMBODIMENT

Figure 1:
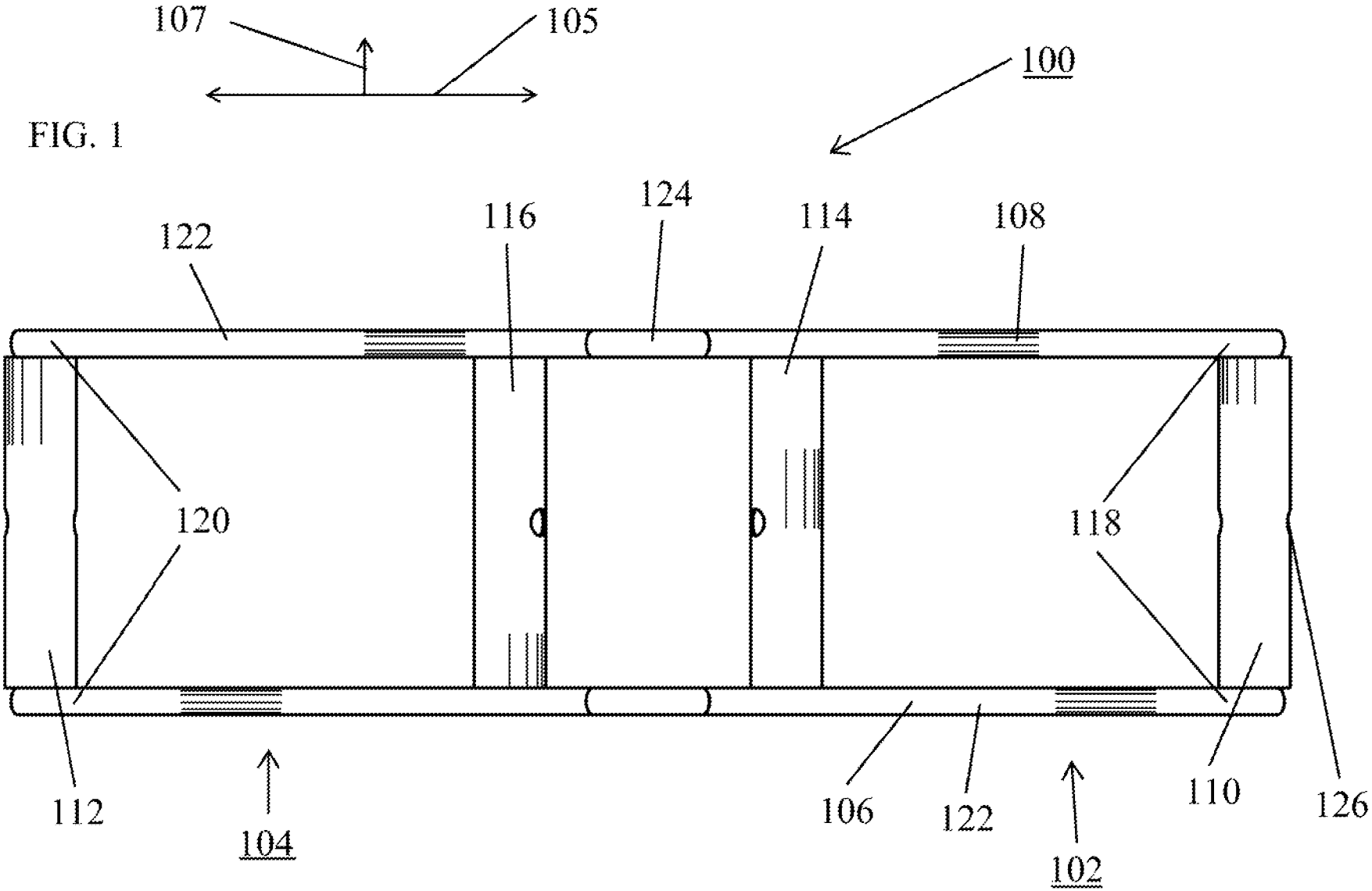
FIG. 1 is a schematic top plan view of the exercise device.
Figure 2:
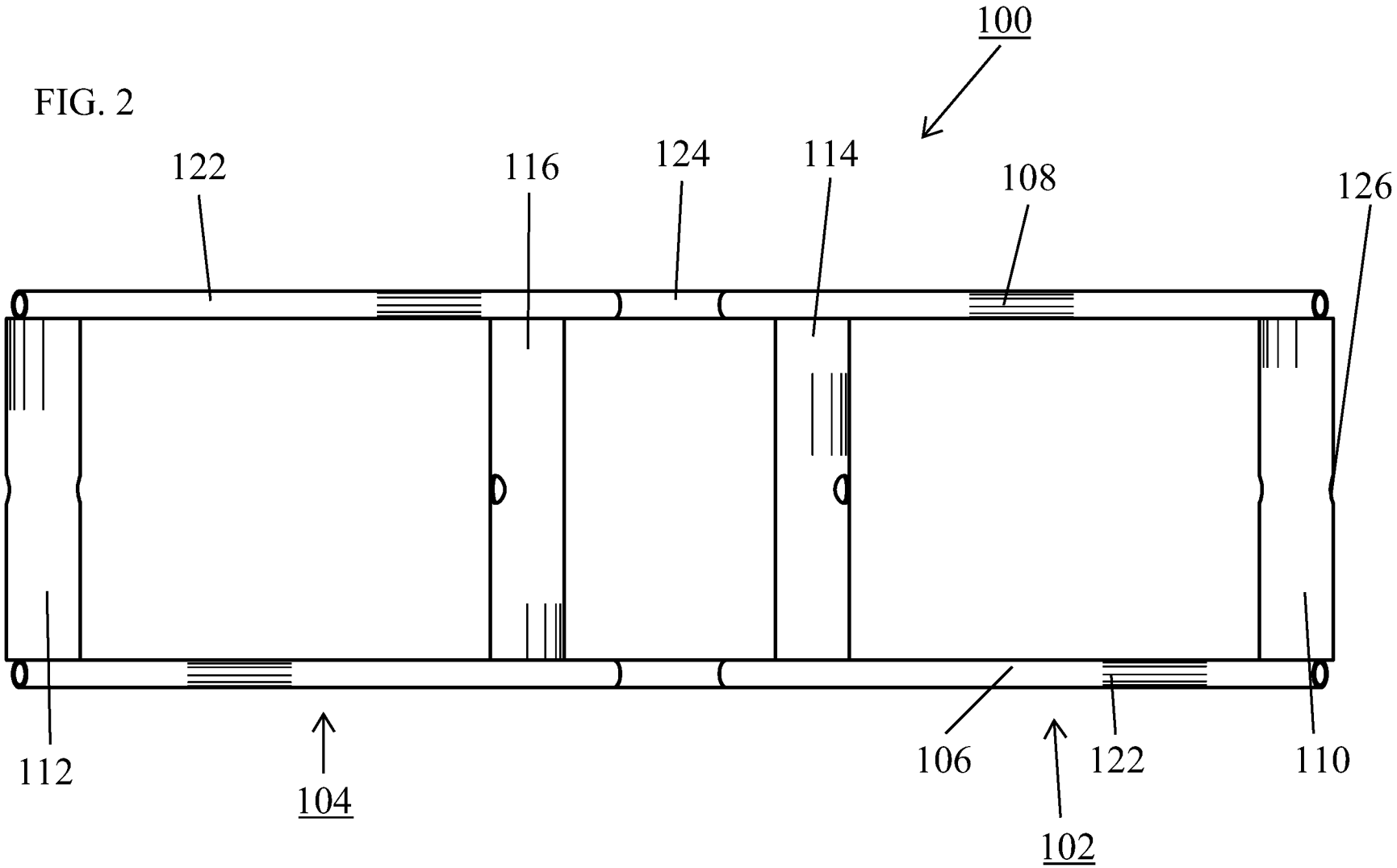
FIG. 2 is a schematic bottom plan view of the exercise device shown in FIG. 1.
Figure 3:
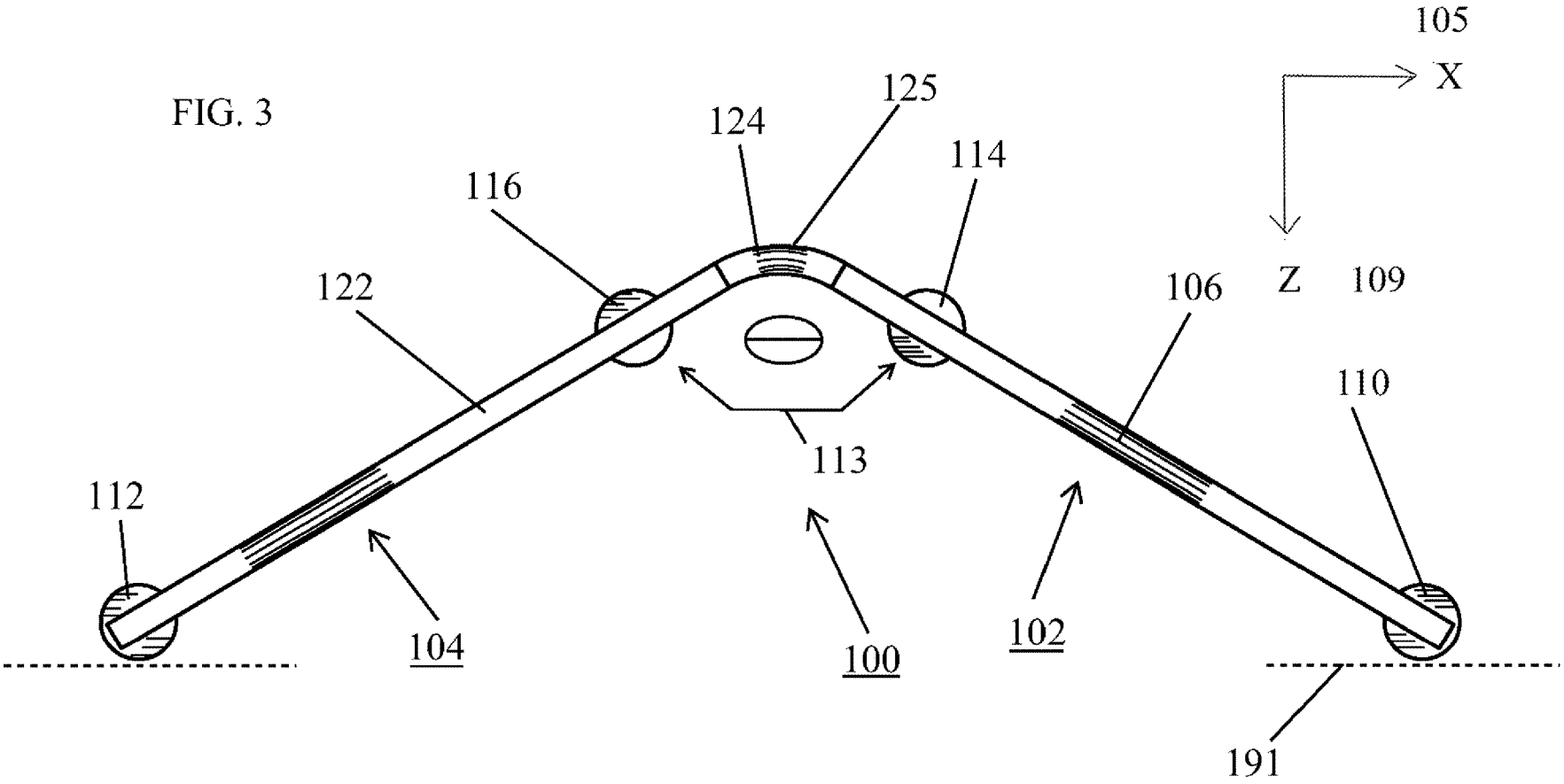
FIG. 3 is a schematic side elevational plan view of the exercise device shown in FIG. 1.
Figure 4:
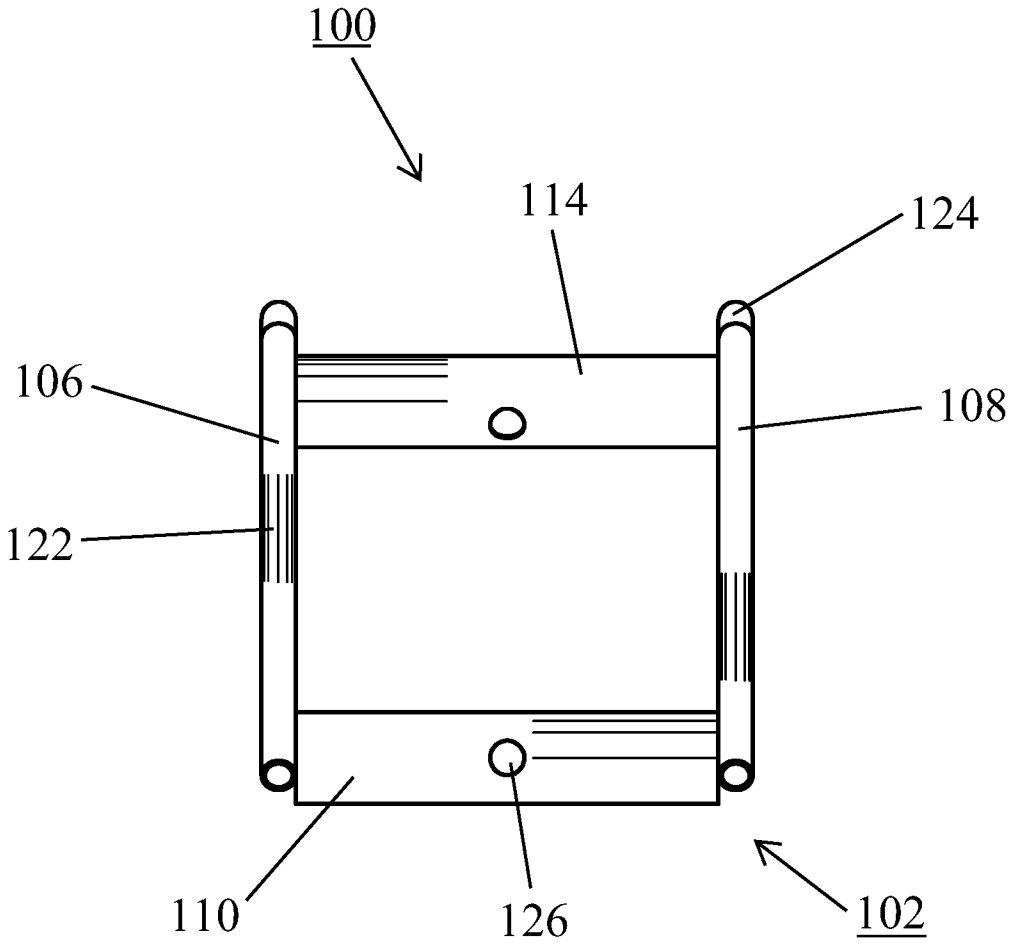
FIG. 4 is a schematic plan end view of the exercise device shown in FIG. 1.

Referring first of all to FIGS. 1-5 the present concept exercise device includes a first frame member 106 which includes a right straight section 150, an arcuate section 124 and a left straight section 152. Exercise device 100 further includes a second frame member 108 which also includes right straight section 150 arcuate section 124 and left straight section 152. The first frame member 106 is spaced apart from and parallel to second frame member 108 and the frame members 106 and 108 are connected together with a number of grips, namely right outer grip 110, left outer grip 112, right inner grip 114 and left inner grip 116. Each of the frame members 106 and 108 have a right end 118 and a left end 120 and also define a right side 102 and a left side 104. Exercise device 100 is shown in the upright position 111 and each of the grips 110, 112, 114, and 116 include a grip aperture 126.

Figure 7:
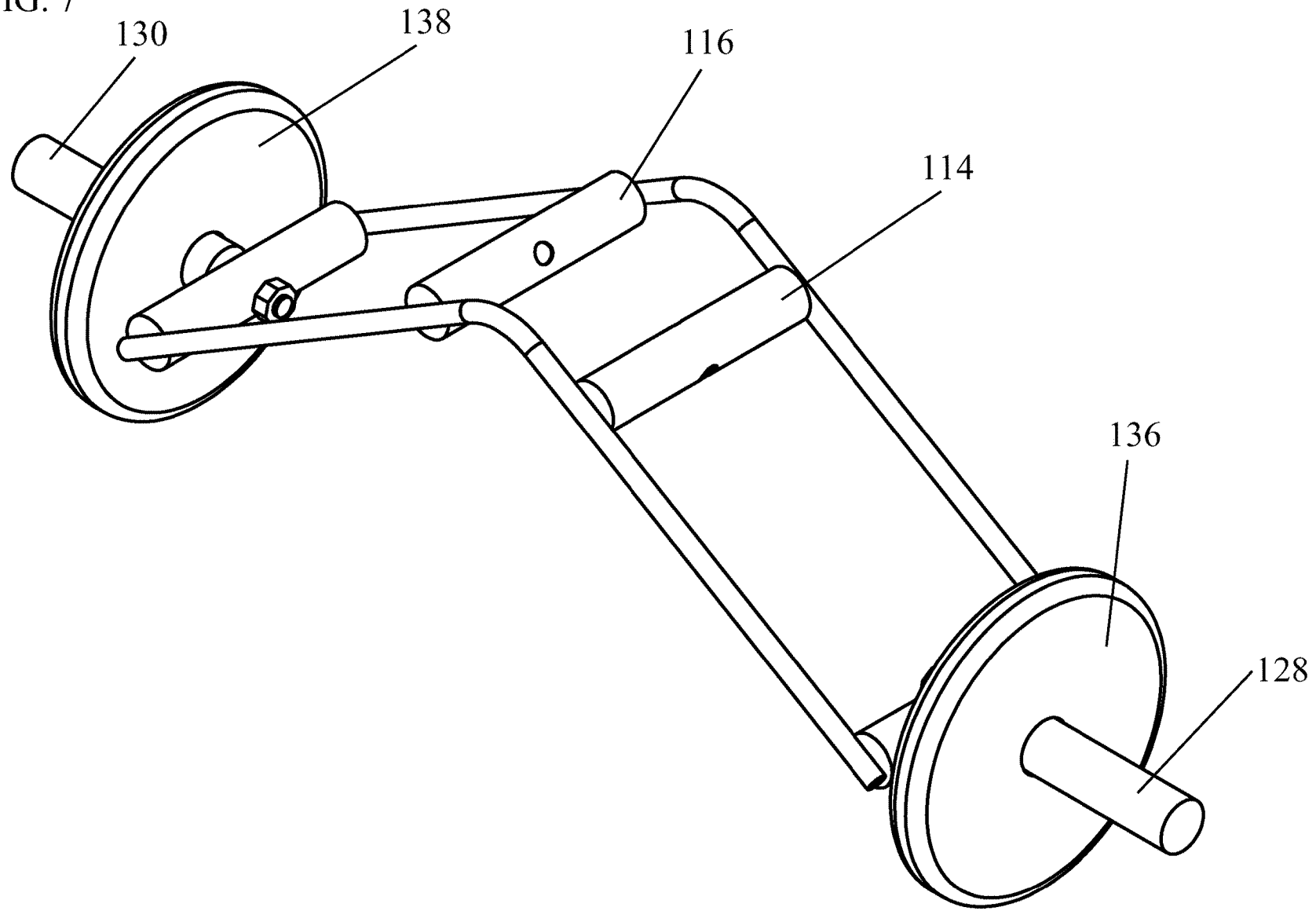
FIG. 7 is a schematic top side perspective view of the exercise device together with outer handle bars and free weight plates deployed thereon.
Figure 8:
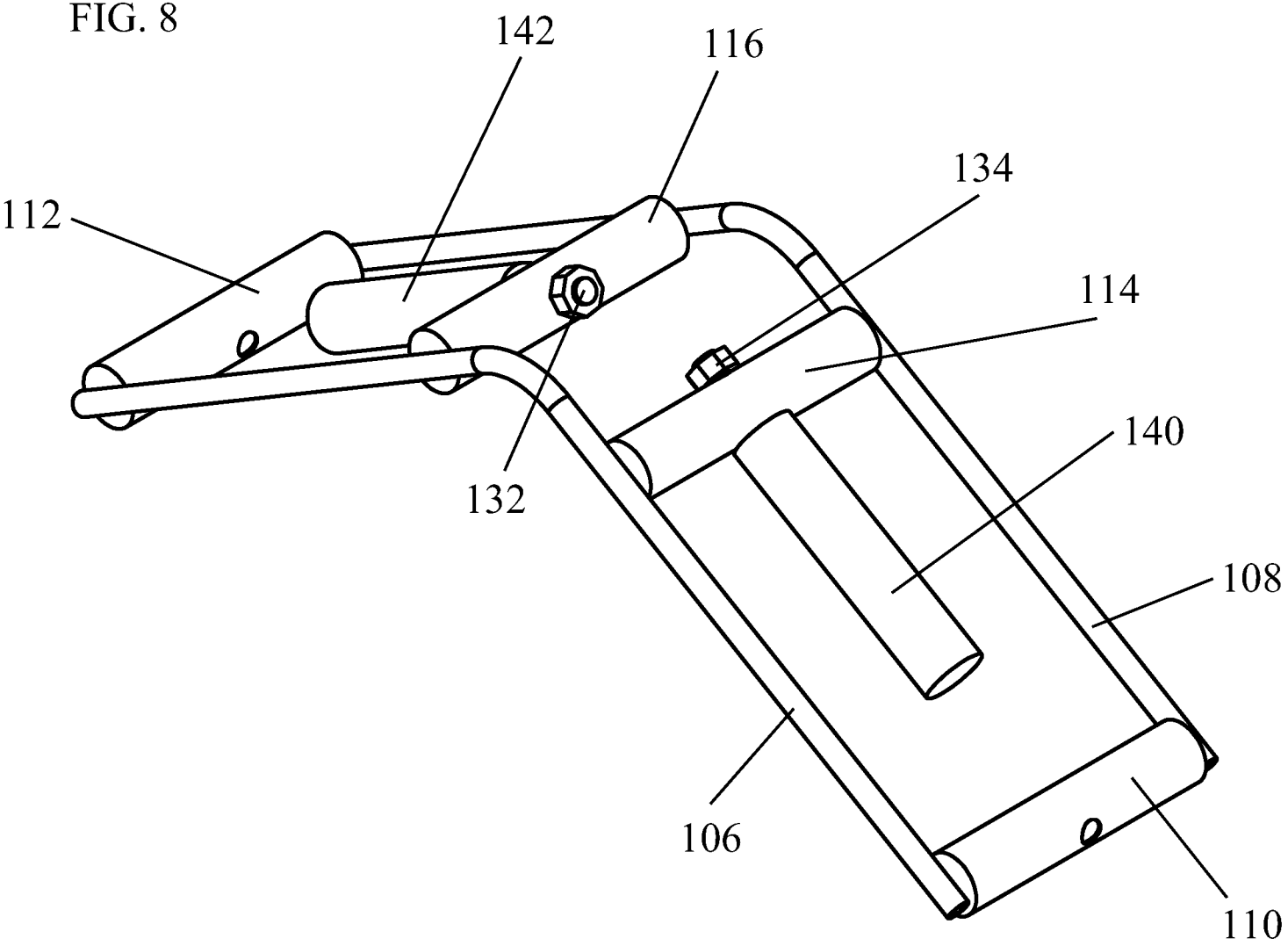
FIG. 8 is a schematic top side perspective view of the exercise device together with inner handle bars deployed thereon.

The basic exercise device 100 is depicted in detail in FIGS. 1-5. In addition to the basic exercise device 100 shown in FIGS. 1-5, a number of attachments can be affixed and used with exercise device 100 as depicted in FIGS. 6, 7 and 8.

Figure 6:
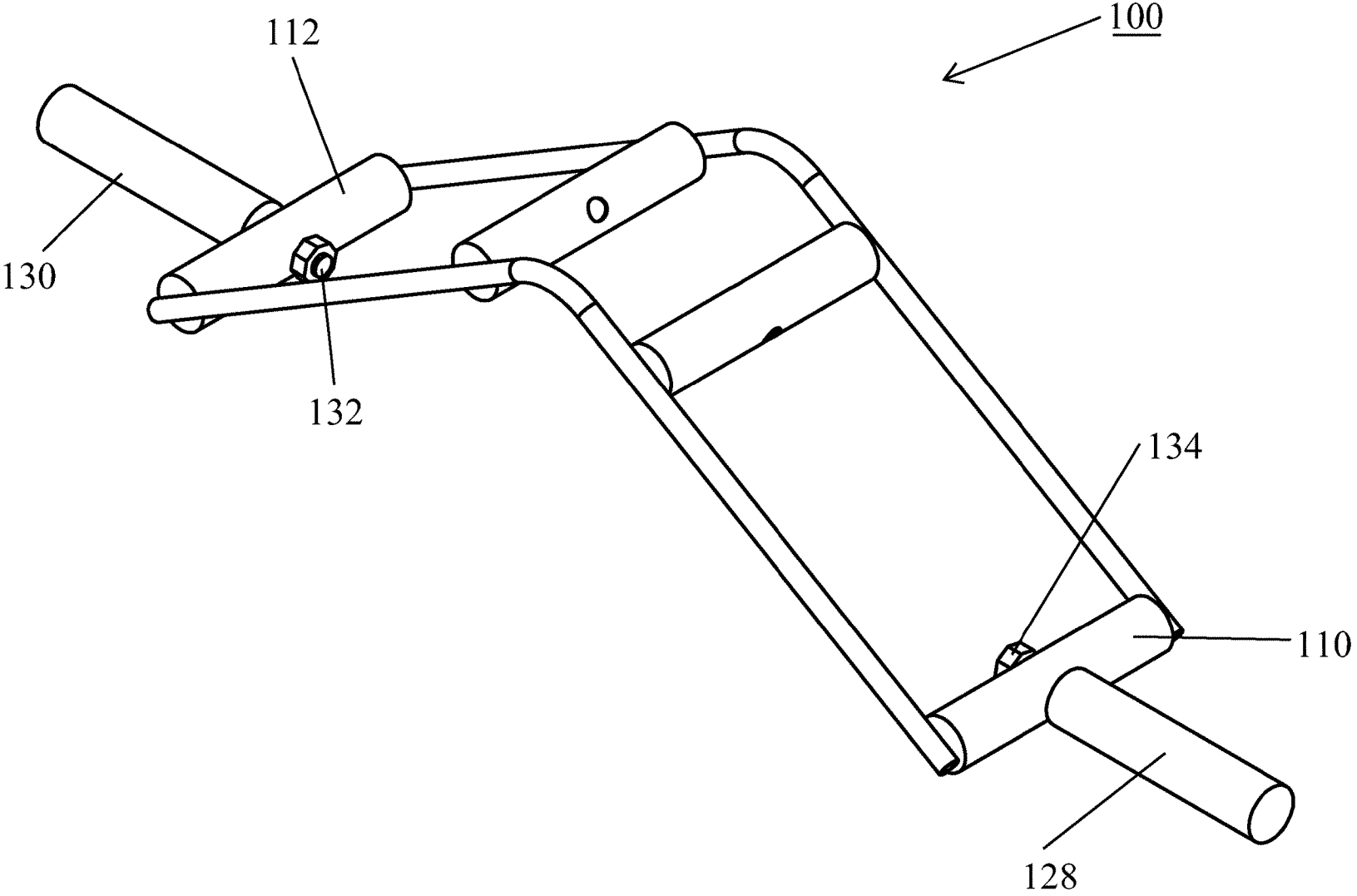
FIG. 6 is a schematic top side perspective view of the exercise device together with outer handle bars deployed thereon.

Referring now to FIG. 6 the reader will note that the handle bars, namely right outer handle bar 128 and left outer handle bar 130, can be rigidly connected to right outer grip 110 and left outer grip 112 respectively using a threaded rod 132 and a nut 134. Right outer handle bar 128 comes fitted with a threaded rod 132 which is received through grip aperture 126 and thereafter nut 134 is threaded on to threaded rod 132 thereby rigidly connecting right outer handle bar 128 and left outer bar 130 to right outer grip 110 and left outer grip 112 respectively.

Handle bars 128 and 130 can be used to grip in the hand without further weight added such that the inherent weight of the exercise device 100 can be used in various exercises. It also possible as shown in FIG. 7 to add free weight plates on to right outer handle bar 128 and left outer handle bar 130 as shown in FIG. 7. Right outer free weight plate 136 is slidably received onto right outer handle bar 128 and left outer free weight plate 138 is slidably received to left outer handle bar 130. Not shown in the diagram, but well known in the art, are devices which connect onto the handle bars 128 & 130, thereby ensuring that the free weight plate 136 and 138 are unable to slide off of handle bars 128 and 130.

Now the user can grip the remaining portion of outer handle bars 128 and 130 and carry out various exercises and/or use inner grips 114 and 116 in a close grip position with free weights 136 and 138 creating additional resistance in any exercises that are carried out with the free weight plates 136 and 138 in place.

Reader will note that handle bars 128 and 130 are large enough to accommodate a number of free weight plates 136 and 138 thereby allowing one to select the amount of weight that is placed on outer handle bars 128 and 130.

Referring now to FIG. 8 the reader will note that it is also possible to attach right inner handle bar 140 onto right inner grip 114 and left inner handle bar 142 onto left inner grip 116 in a similar fashion as was described in right outer handle bar 128 and left outer handle bar 130. Inner handle bars 140 and 142 are fitted with threaded rod 132 and a nut 134 for rigidly affixing the inner handle bars 140 and 142 to the inner grips 114 and 116 respectively.

Referring now to FIGS. 5, 6, 7 and 8 together the reader will note that it is possible to create any combination of inner handle bars 140, 142 outer handle bars 128 and 130 together with outer free weight plates 136 and 138 and possibly inner free weight plates not shown in the diagrams which would be mounted onto inner handle bar 140 and inner handle bar 142. It is noted that any weights which would be attached to inner handle bars 140 and 142 would be smaller in size due to the limitation of the outer diameter of the weights impinging upon the first frame member 106 and second frame member 108, however it is possible to attach weights to either of the outer handle bars 128 and 130 or the inner handle bars 140 and 142 or both simultaneously.

It follows that it is possible to have outer handle bars 128 and 130 mounted onto outer grips 110 and 112 at the same time having inner handle bars 140 and 142 mounted onto inner grips 114 and 116 thereby creating a very flexible handle bar and free weight plate combination.

Figure 5:
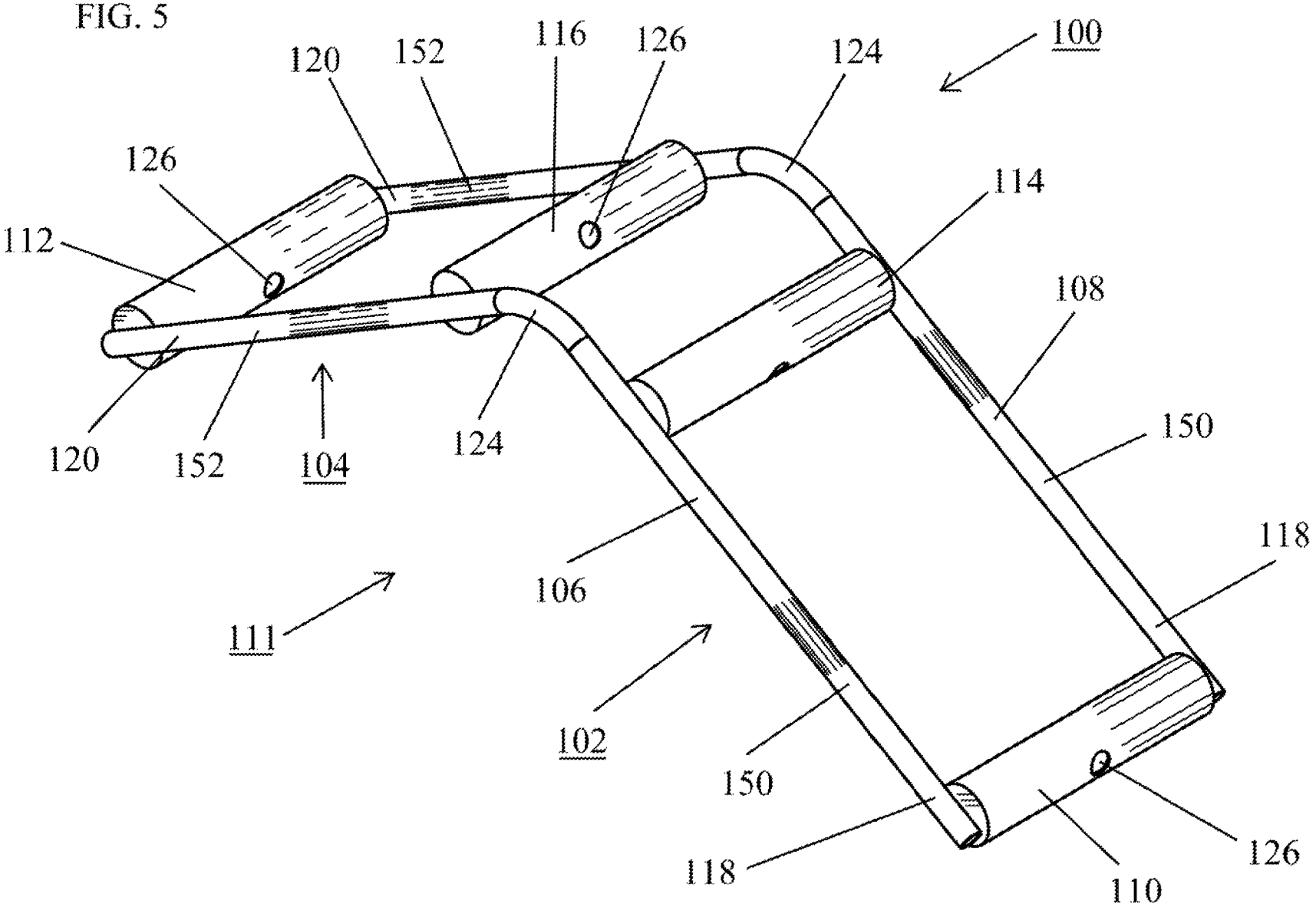
FIG. 5 is a schematic top side perspective view of the exercise device shown in FIG. 1.

The reader will note that although the exercise devises 100 is shown in the upright position 111 in FIG. 5 it is also possible to use the exercise the device 100 in an inverted position (not shown) wherein the unit would be supported by the apex of the arcuate section 124.

In Use

Exercise device 100 can be used to carry out a number of different exercises. For example, it is possible to perform stable close grip, wide grip and tricep push-up exercises with the exercise device 100 in the upright position 111 on the floor or on a bench as well as unstable close, wide and tricep grip push-up exercises with the exercise device 100 in the inverted position (not shown in the diagrams) where the device is supported by the apex of the arcuate section 124 on the floor or on a bench.

A variety of upper body exercises can be performed using exercise device 100 by gripping either outer grips 114 and 116 or inner grips 110 and 112. Outer grips 114 and 116 can be used for shoulder press exercises, front lateral raises, one-arm bicep curls, regular grip tricep extensions while the user is standing or laying down, wide grip back extensions, wide grip bent over rows, It is also possible to do exercises using hammer style gripping on inner grips 114 and 116 and or outer grips 110 and 112. To carry out a hammer grip the exerciser grasps the outer grips and or the inner grips as one would grasp a hammer with the palm of the hands facing each other. Therefore it is possible to conventionally grip exercise device 100 using the attachment outer handle bars 128 and 130 or inner handle bars 140 and 142 and or use hammer style gripping using the outer grips 110 and or 112 and or use the inner grips 114 and 116.

Therefore there is flexibility in how the exercise device 100 can be gripped by the user by using handle bar attachments 128 and 130 and also handle bar attachment 140 and 142. There is also flexibility in adding weights for example, one can add weights to only the outer handle bars 128, 130, or only the inner handle bars 140, 142 or both or none. Furthermore, the exercise device can be used for close grip, medium grip and wide grip back extensions when a rubber band is connected to the arcuate section 124 and mounted to a ceiling or above the user's head.

Additional exercises that can be performed include front and behind shoulder shrugs; bicep curls including preacher, one-arm and hammer grip bicep curls; weighted squats, weighted lunges, hacksaws, upright rows and side shoulder laterals.

I claim:

1. An exercise device includes:

a) a first frame member spaced apart and parallel to a second frame member oriented along a longitudinal direction, each of the first and second frame members having a distal right end and distal left end for placing onto a support surface in an upright position;

b) four spaced apart transversely oriented grips, configured to rigidly connect together the first and second frame members, the four spaced apart transversely oriented grips including:

a right outer grip and a left outer grip which are located at each of the distal right end and distal left end of the first and second frame members, and a right inner grip and a left inner grip equally spaced from the distal right and distal left end, respectively, such that in the upright position, the right and left inner grips are elevated from the supporting surface, each of the right and left outer grips and the distal right and left inner grips including a grip aperture for attaching:

a longitudinally oriented right inner handle bar and a left inner handle bar to the right and left inner grips, respectively, and a longitudinally oriented right outer handle bar and a left outer handle bar to the right and left outer grips, respectively, the right and left inner handle bars, and the right and left outer handle bars each being a cylindrically shaped rod configured for grasping with a hand and for slideably receiving weight plates thereon; and c) wherein each of the first and second frame members includes equi-length right and left straight sections connected by a central arcuate section, wherein each of the first and second frame members define an angle theta such that in the upright position the first and second frame members are each inverted V shapes.

2. The exercise device claimed in claim 1 wherein the right outer grip and the left outer grip are located such that in the upright position the right outer and left outer grips contact the supporting surface.

3. The exercise device claimed in claim 2 wherein the right outer grip and the left outer grip are configured such that in the upright position, the outer diameter of the weight plates make contact with the supporting surface.

4. The exercise device claimed in claim 3 wherein the right and left outer handle bars, extend longitudinally outwardly from the right outer grip and the left outer grip.

5. The exercise device claimed in claim 1 wherein the right and left outer handle bars and the right and left inner handle bars include longitudinally oriented threaded rods extending from one end of the respective handle bar for thread-ably attaching into the grip aperture.

6. The exercise device claimed in claim 5 wherein the left and right inner handle bars, and the right and left outer handle bars, each have an outer diameter dimensioned to slide-ably receive a weight plate of the weight plates thereon.

7. The exercise device claimed in claim 1 wherein the angle theta is between 90 degrees and 170 degrees.

8. The exercise device claimed in claim 1 wherein the angle theta is between 100 degrees and 140 degrees.

9. The exercise device claimed in claim 1 wherein the angle theta is between 110 degrees and 130 degrees.

10. The exercise device claimed in claim 1 wherein in an inverted position the apex of the arcuate sections makes contact with the supporting surface and the first and second frame members each define upright V shapes.

11. An exercise device includes:

a) a first frame member spaced apart and parallel to a second frame member oriented along a longitudinal direction, each of the first and second frame members having a right and left end;

b) wherein each of the first and second frame members includes equi-length right and left straight sections connected by a central arcuate section wherein the first and second frame members each define an angle theta such that in an upright position the first and second frame members are each inverted V shapes;

c) four spaced apart transversely oriented grips, configured to rigidly connect together the first and second frame members;

d) wherein the four spaced apart transversely oriented grips include a right outer grip and a left outer grip which are located at each of a distal right end and a distal left end of the first and second frame members, and include a right inner grip and a left inner grip equally spaced from the distal right end and distal left end, respectively, such that in the upright position, the right and left inner grips are elevated from the supporting surface;

e) the right and left outer grips and the distal right and left inner grips including a grip aperture for attaching: a longitudinally oriented right inner handle bar and a left inner handle bar to the right and left inner grips, respectively, and a longitudinally oriented right outer handle bar and a left outer handle bar to the right and left outer grips, respectively, the right and left inner handle bars, and the right and left outer handle bars each being a cylindrically shaped rod configured for grasping with a hand and for slideably receiving weight plates thereon.

12. The exercise device claimed in claim 11 wherein the right outer handle bar and the left outer handle bar extend longitudinally outwardly from the right outer grip and the left outer grip away from the first and second frame members.

13. The exercise device claimed in claim 12 wherein the right outer handle bar and left outer handle bar includes a right outer free weight plate of the free weight plates and left outer free weight plate of the free weight plates thereon, such that in the upright position the outer diameter of the free weight plates make contact with the supporting surface.

14. The exercise device claimed in claim 13 wherein the left and right outer handle bars extend longitudinally outwardly from the right outer grip and the left outer grip.

15. An exercise device includes:

a) a first frame member spaced apart and parallel to a second frame member oriented along a longitudinal direction, each of the first and second frame members having a right and left end for placing onto a support surface in an upright position;

b) four spaced apart transversely oriented grips, configured to rigidly connect together the first and second frame members, the four spaced apart transversely oriented grips including:

a right outer grip and a left outer grip which are located at each of the distal right and left ends of first and second frame members, and a right and left inner grip equally spaced from the distal right and a left ends respectively such that in the upright position, the right and left inner grips are elevated from the supporting surface, the right outer grip and the left outer grip each including a grip aperture for attaching:

a longitudinally oriented right outer handle bar and left outer handle bar to the right and left outer grips, respectively, each of the right and left outer handle bars and the right and left inner handle bars being a cylindrically shaped rod configured for grasping with a hand and for slideably receiving free weight plates thereon; and c) wherein each of the first and second frame members includes equi-length right and left straight sections connected by a central arcuate section wherein the first and second frame members each define an angle theta such that in the upright position the first and second frame members are each inverted V shapes.

* * * * *